US006050705A

United States Patent [19]

Kusserow et al.

[11] Patent Number: 6,050,705

[45] Date of Patent: Apr. 18, 2000

[54] VEHICLE HEADLIGHT HAVING PREDETERMINED LIGHT PROJECTING CHARACTERISTICS

[75] Inventors: Peter Kusserow, Commerce, Mich.; Heike Eichler, Reutlingen, Germany

[73] Assignee: Robert Bosch GmbH, Stuttgart, Germany

[21] Appl. No.: 09/017,740

[22] Filed: Feb. 3, 1998

[30] Foreign Application Priority Data

Feb. 6, 1997 [DE] Germany ..... 197 04 426

[51] Int. Cl.[7] ..... F21V 13/04

[52] U.S. Cl. ..... 362/299; 362/302; 362/305; 362/517; 362/538

[58] Field of Search ..... 362/299, 300, 362/302, 304, 305, 308, 309, 327, 328, 332, 517, 520, 522, 538, 539

[56] References Cited

U.S. PATENT DOCUMENTS

| | | | |
|---|---|---|---|
| 1,433,292 | 10/1922 | Myers et al. | 362/522 |
| 1,571,139 | 1/1926 | Nolen | 362/522 |
| 1,603,157 | 10/1926 | Sheaffer | 362/538 |
| 4,772,987 | 9/1988 | Kretschmer et al. | 362/539 |
| 4,814,950 | 3/1989 | Nakata | 362/539 |
| 4,949,226 | 8/1990 | Makita et al. | 362/538 |
| 5,070,432 | 12/1991 | Kitazumi et al. | 362/538 |

FOREIGN PATENT DOCUMENTS

| | | | |
|---|---|---|---|
| 406565 | 1/1991 | European Pat. Off. | 362/299 |
| 581048 | 2/1994 | European Pat. Off. | 362/299 |

*Primary Examiner*—Alan Cariaso
*Attorney, Agent, or Firm*—Michael J. Striker

[57] ABSTRACT

There is provided a vehicle headlight having a light emitter for emitting light and a reflector for reflecting light in a generally convergent manner. The headlight also includes a lens for passage therethrough of light reflected from the reflector. The vehicle headlight further includes a peripheral light enhancing member disposed relative to the lens for receiving at least a portion of the light exiting the headlight without passing through the lens, the peripheral light enhancing member generally following the trace of at least a portion of the outer periphery of the lens and forming a pass through portion through which light may pass substantially without alteration thereof, and the peripheral light enhancing member having the characteristic to permit at least a portion of the light emitted by the light emitter to pass therethrough and having the characteristic to permit at least a portion of light falling on the headlight from outside of the headlight to pass therethrough.

23 Claims, 2 Drawing Sheets

VEHICLE HEADLIGHT HAVING PREDETERMINED LIGHT PROJECTING CHARACTERISTICS

BACKGROUND OF THE INVENTION

The present invention relates to a vehicle headlight having predetermined light projecting characteristics.

A headlight is disclosed in U.S. Pat. No. 4,949,226 which comprises a lights source and a reflector for reflecting emitted light from the light source as a convergent light beam. A lens is disposed in the light beam path and the light beam passes through the lens. A plate is disposed outward of the lens in the light beam travel direction and the plate includes a coating which is partially light transparent and partially light reflecting. The coating permits the light beam to pass therethrough; however, some of the light outside of the headlight which falls on the headlight is reflected by the coating. The plate extends over the path of such incoming outside light as well as the entire extent of the cross section of the light beam. In the "off" condition of the headlight, the headlight exhibits an integrated illumination image as the outside light is reflected outward by the coated plate. In the "on" condition of the headlight, not only the lens appears to be illuminated but the entire light passage aperture of the headlight appears to be illuminated due to the partially light transparent coated plate. A deflecting plate is disposed relative to the lens to deflect through total reflection, during the "on" position of the headlight, a portion of the light passing through the lens so that this deflected light passes through the plate. This deflecting plate requires a relatively large installation effort and thus increases the production cost of the headlight. Also, the partially reflecting property of the coated plate reduces the intensity of the light which ultimately exits through the lens.

SUMMARY OF THE INVENTION

The present invention advantageously minimizes the number of additional components of a vehicle headlight needed to illuminate the interior of the headlight. This is accomplished, in one aspect of the present invention, by a vehicle headlight having a light emitter for emitting light and a reflector for reflecting light in a generally convergent arrangement. The vehicle headlight also includes a lens for passage therethrough of light reflected from the reflector. The vehicle headlight further includes a peripheral light enhancing member disposed relative to the lens for receiving at least a portion of the light exiting the headlight without passing through the lens, the peripheral light enhancing member generally following the trace of at least a portion of the outer periphery of the lens and forming a pass through portion through which light may pass substantially without alteration thereof, and the peripheral light enhancing member having the characteristic to permit at least a portion of the light emitted by the light emitter to pass therethrough and having the characteristic to permit at least a portion of light falling on the headlight from outside of the headlight to pass therethrough.

DETAILED DESCRIPTION OF THE PREFERRED EMBODIMENTS

Figure 1:
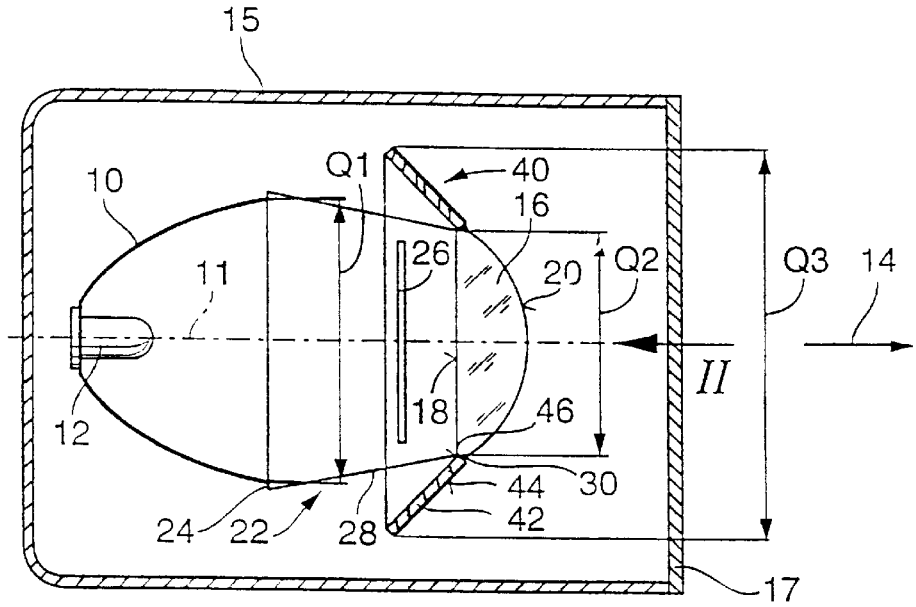
FIG. 1 is a side elevational view, in vertical section, of a one embodiment of the vehicle headlight of the present invention.
Figure 2:
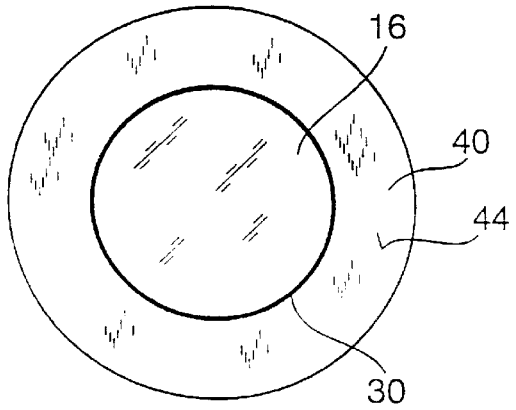
FIG. 2 is a front elevational view of the principal lens and ring lens of the one embodiment of the vehicle headlight of the present invention shown in FIG. 1.

As seen in FIG. 1 and FIG. 2, the one embodiment of the vehicle headlight of the present invention is particularly suited for truck vehicles and the like and is designed in accordance with predetermined light projecting characteristics for the particular purpose of producing a blended light. The vehicle headlight includes a reflector 10 made of metal or plastic in whose focal region is disposed a light emitter 12. The light emitter 12 can be a glow lamp, a gas discharge lamp, or another suitable lamp. In the light exit direction light exit direction 14, as viewed with respect to the reflector 10, a lens 16 is disposed which is comprised of glass or plastic. The lens 16 can have, for example, a planar side 18 oriented toward the reflector 10 and an opposed convex shaped side 20. The lens 16 is retained in a retaining element 22 which is connected to a forward edge 24 of the reflector 10 oriented in the direction of the light exit direction 14. The reflector 10 and the lens 16 can be housed in a housing 15 which comprises a light exit aperture covered by a light passable plate 17 of glass or plastic. The plate 17 can be flat so that light may pass therethrough without being influenced thereby or, alternatively, at least comprise a limited area optical element acting to refract and, especially, to disperse the light.

The reflector 10 reflects light, emitted by the light emitter 12, as a convergent light bundle which exits the headlight through the lens 16 and is thereby refracted by the lens 16. The lens 16 operates thus as a collection lens and through this the exiting light is dispersed relative to the optical axis 11 of the reflector 10. The reflector 10 can, for example, be of a shape approaching an ellipsoid shape, a generally elliptical shape, or a numerically determined shape dictated by the characteristic of the light bundle projected from the headlight. A light blocking screen 26 can be disposed between the reflector 10 and the lens 16, the screen for the most part being below the optical axis 11 and which blocks a portion of the exiting light to the extent that only a part of this light bundle reflected by the reflector 10 can pass by the screen 26.

The portion of the exiting light bundle which passes by the screen 26 is characterized by a distinct light-dark border by the top edge of the screen 26 and this exiting light then passes through the lens 16 as a blended light having a light-dark border. Alternatively, the screen 26 can be omitted if the form of the reflector 10 is so chosen that the reflected light bundle already comprises the desired light-dark border.

The reflector 10 has on its forward edge 24 a cross section Q1 and the lens 16 has a cross section Q2 smaller than the cross section Q1. The retaining element 22 comprises one or several extending elements 28 which extend from adjacent the forward edge 24 of the reflector 10 in the light exit direction 14 to adjacent the lens 16, at which the extending elements 28 may be connected to one another, for example, by a ring shaped member 30. The lens 16 is retained by the edge of the ring shaped member 30. The extending elements 28 form openings therebetween through which light from the light emitter 12 which has not been reflected by the reflector 10 can pass. The extending elements 28 can thereby be configured as small as possible in order to maximize these light passing openings and thereby ensure that a correspondingly large portion of the light from the light emitter 12 can pass outward of the headlight.

In accordance with the present invention, a light enhancing member peripheral light enhancing member 40 is provided which extends at least partially around the periphery of the lens 16. The peripheral light enhancing member 40 can be comprised of a light passing material such as, for example, a glass or plastic body portion 42 on which a coating 44 is disposed which is partially light passing and partially light reflecting. The coating 44 is preferably disposed on the outer side of the body portion 42 oriented in the light exit direction 14. The coating 44 is preferably comprised of a metal such as, for example, aluminum, chrome, or iron and can be applied to the body portion 42 by sponging, sputtering, lacquering or another suitable process.

Through judicious selection of the material of the coating 44 and through judicious selection of the thickness of the coating, it can be achieved that the coating permits a predetermined portion of light to pass through while reflecting another predetermined portion of light. The thicker that the coating 44 is, the greater is the portion of light which is reflected and, correspondingly, the smaller is the portion of light which is permitted to pass through. The configuration of the coating 44 can even permit a desired lighting or reflectivity characteristic of the peripheral light enhancing member 40 in the "on" or powered condition of the headlight without consequently producing an undesired mixing of the light.

The peripheral light enhancing member 40 includes an opening 46 which has a cross section approximating the cross section Q2 of the lens 16 so that the light passing through the lens 16 does not also pass through the peripheral light enhancing member 40. The peripheral light enhancing member 40 extends only over that portion of the light dispersal path of the exiting light which does not pass through the lens 16. As the afore described light strength distribution arrangement produces a blended light, the light bundle passing through the lens 16 is not weakened or dimmed by prior passage through the peripheral light enhancing member 40 with its only partially light passing characteristic. The peripheral light enhancing member 40 can be retained in a not further illustrated manner on the retaining element 22 or on another piece of the headlight such as, for example, on the housing 15. The peripheral light enhancing member 40 can moreover be used as a retaining piece for the lens 16 so that the additional retaining element 22 can be omitted.

The peripheral light enhancing member 40 of the vehicle headlight of the one embodiment shown in FIGS. 1 and 2 has a generally conical form tapering in the light exit direction 14. The peripheral light enhancing member 40 encircles the lens 16 around its entire periphery and is thus tube or frusto conical shaped. The light exit direction 14 extends from the lens 16 in a direction opposite to the light exit direction 14 to close to but not reaching the forward edge of the reflector 10. In the end area of the peripheral light enhancing member 40 oriented toward the reflector 10, the peripheral light enhancing member 40 has a cross section Q3 greater than that of the reflector 10 at its forward edge 24 so that the peripheral light enhancing member 40 overranges the reflector 10. In the "on" or powered condition of the headlight, light emitted from the light emitter 12 passes through the openings in the retaining element 22 and a portion of the light passes through the peripheral light enhancing member 40. A bending or diversion of the light by the peripheral light enhancing member 40 thus does not occur or only occurs to a relatively small degree. If one were to look into the headlight in its "on" or powered condition, one would see not only the lens 16 illuminated but also the peripheral light enhancing member 40 so that in total a relatively large illuminated surface would be seen and the light passing through the lens 16 would appear subjectively relatively less blinding to the observer. In the "off" or unpowered condition of the headlight, one looking into the headlight through the coating 44 would see an integral, reflective, and brilliant lighting scheme.

Figure 3:
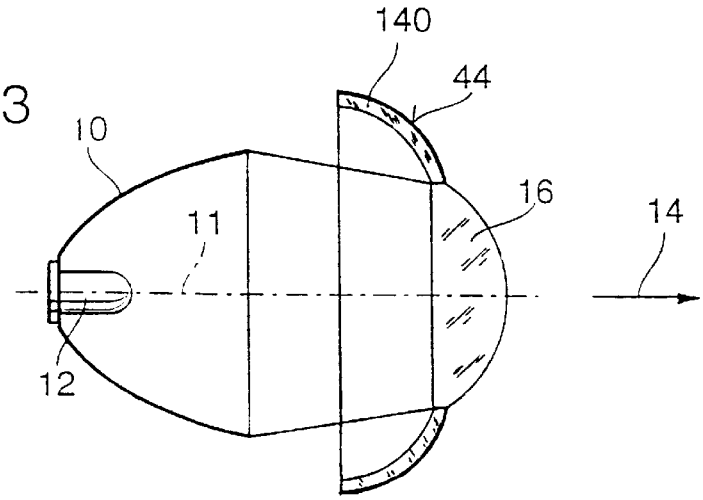
FIG. 3 is a side elevational view, in vertical section, of another embodiment of the vehicle headlight of the present invention.

In FIG. 3, another embodiment of the vehicle headlight of the present invention is illustrated. The peripheral light enhancing member 140 encircles the lens 16 over its entire circumference and tapers inwardly in the light exit direction 14. The peripheral light enhancing member 140 extends in the direction opposite to the light exit direction 14 to close to but not reaching the forward edge 24 of the reflector 10 and exhibits at that location a cross section Q3 which is greater than the cross section Q1 of the reflector 10 so that the reflector 10 is overranged by the peripheral light enhancing member 140. The peripheral light enhancing member 140 is convex and includes the coating 44 on its outer surface oriented in the light exit direction 14. The performance of the peripheral light enhancing member 140 is similar to that described with respect to the one embodiment of the vehicle headlight shown in FIGS. 1 and 2.

Figure 4:
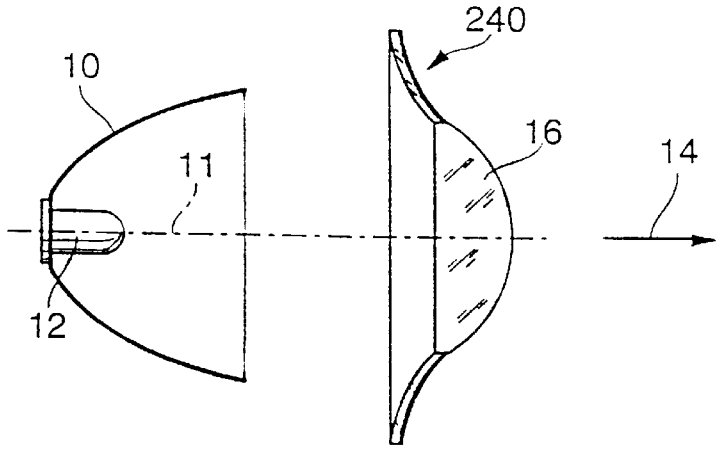
FIG. 4 is a side elevational view, in vertical section, of a further embodiment of the vehicle headlight of the present invention.

In FIG. 4, a further embodiment of the vehicle headlight of the present invention is illustrated. The peripheral light enhancing member 240 encircles the lens 16 over its entire circumference and tapers inwardly in the light exit direction 14. The peripheral light enhancing member 240 extends in the direction opposite to the light exit direction 14 to close to but not reaching the forward edge 24 of the reflector 10 and exhibits at that location a cross section Q3 which is greater than the cross section Q1 of the reflector 10 so that the reflector 10 is overranged by the peripheral light enhancing member 240. The peripheral light enhancing member 240 is concave and includes the coating 44 on its outer surface oriented in the light exit direction 14. The performance of the peripheral light enhancing member 240 is similar to that described with respect to the one embodiment of the vehicle headlight shown in FIGS. 1 and 2.

Figure 5:
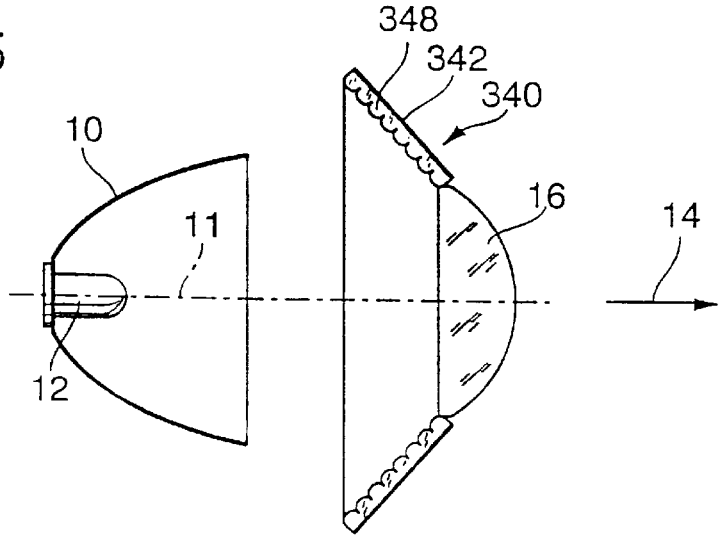
FIG. 5 is a side elevational view, in vertical section, of an additional embodiment of the vehicle headlight of the present invention.

In FIG. 5, an additional embodiment of the vehicle headlight of the present invention is illustrated. The peripheral light enhancing member 340 is configured substantially the same as the peripheral light enhancing member 40 of the one embodiment shown in FIGS. 1 and 2 with the additional feature that the body portion 342 is provided with a plurality of optical elements 348. The optical elements 348 are preferably disposed on the inner side of the peripheral light enhancing member 340 oriented opposite to the light exit direction 14—namely, the side of the peripheral light enhancing member 340 which does not have the coating 344. The optical elements 348 can be prisms or lenses such as, for example, cylinder lenses, so that light entering these elements is either bent or refracted in a predetermined direction or is dispersed in a predetermined direction. The optical elements 348 enable a predetermined light strength distribution arrangement to be achieved with respect to the light passing therethrough. Preferably, this permits an additional light strengthening or intensification to be achieved with this light in addition to the intensification which such light has received from passage through the lens 16 without, however, disturbing this previous intensification and whereby the additional intensification is of lesser strength than the intensification provided by the lens 16.

The additional light bundle passing through the peripheral light enhancing member 340 can be used to illuminate the same area as is illuminated by the light bundle passing through the lens 16 or this light bundle can be used to illuminate another area such as an area above the light-dark border of the light passed through the lens 16. In all other respects, the performance of the peripheral light enhancing member 340 in this additional embodiment in similar to that described with respect to the one embodiment shown in FIGS. 1 and 2. The optical elements 348 can also be implemented in the another and further embodiments of the vehicle headlight disclosed herein as well as the further additional embodiment of the vehicle headlight shown in FIG. 6.

Figure 6:
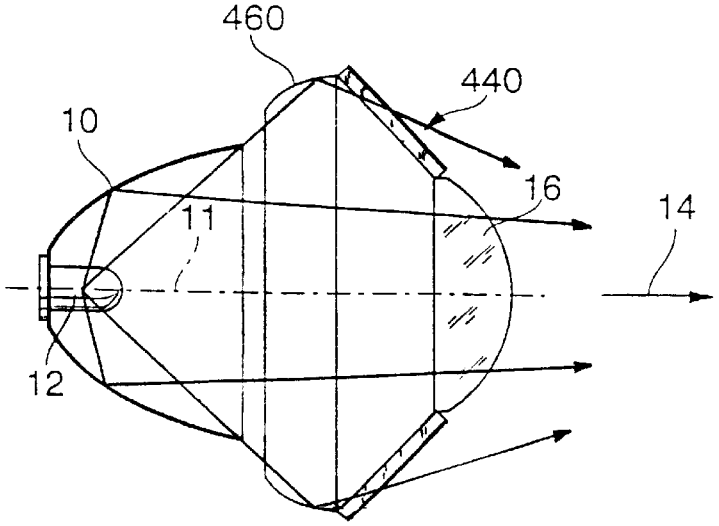
FIG. 6 is a side elevational view, in vertical section, of a further additional embodiment of the vehicle headlight of the present invention.

In FIG. 6, a further additional embodiment of the vehicle headlight of the present invention is shown which can be configured similarly to the embodiments previously disclosed with the additional feature that the peripheral light enhancing member 440 of this embodiment includes at least one supplemental reflector 460 which is disposed between the peripheral light enhancing member 440 and the reflector 10 and which extends over at least a portion of the periphery of the reflector 10.

The supplemental reflector 460 can be disposed to extend in a direction opposite to the light exit direction 14 to relatively adjacent the forward edge 24 of the reflector 10 or to a location at a greater spacing from the forward edge 24. The supplemental reflector 460 can be disposed to extend in the direction of the light exit direction 14 to relatively adjacent the peripheral light enhancing member 440 or to a location at a greater spacing from the peripheral light enhancing member 440. The supplemental reflector 460 is so disposed and configured as to reflect light emitting from the light emitter 12 so that such light passes through the peripheral light enhancing member 440. It can also be provided that such emitted light can pass through the peripheral light enhancing member 440 only after it has been reflected by the supplemental reflector 460 or, instead, that a portion of such emitted light is thereby reflected while another portion of such emitted light passes through the peripheral light enhancing member 440 without reflection by the supplemental reflector 460. The supplemental reflector 460 is so disposed and configured as to reflect light emitting from the light emitter 12 in a horizontally dispersed additional light bundle which passes through the peripheral light enhancing member 440. The peripheral light enhancing member 440 otherwise performs similarly to the peripheral light enhancing members 40 disclosed with respect to the other embodiments.

We claim:

1. A vehicle headlight comprising a light emitter for emitting light;

a reflector for reflecting a portion of the light emitted from the light emitter in a generally convergent arrangement;

a lens arranged so that a fraction of said portion of the light emitted from the light emitter that is reflected by the reflector passes through the lens, said lens having an outer periphery; and a peripheral light enhancing member disposed relative to the lens for receiving a part of the light emitted from the light emitter that does not pass through the lens and that exits the headlight;

wherein the peripheral light enhancing member generally borders at least a portion of the outer periphery of the lens and passes therethrough at least a fraction of said part of said light received by the peripheral light enhancing member and passes therethrough at least a portion of light falling on the headlight from outside of the headlight; and wherein the peripheral light enhancing member tapers in a direction toward the lens from the light emitter.

2. The vehicle headlight as defined in claim 1, further comprising a retaining element for retaining the lens and wherein said retaining element is provided with at least one aperture for permitting passage of light thereby to said peripheral light enhancing member.

3. The vehicle headlight as defined in claim 1, wherein the peripheral light enhancing member has a generally frusto-conical shape.

4. The vehicle headlight as defined in claim 1, wherein the peripheral light enhancing member has a curved shape along at least a portion thereof.

5. The vehicle headlight as defined in claim 1, wherein the peripheral light enhancing member has an end closest to said light emitter, the reflector has an end furthest from said light emitter and said light enhancing member has a cross section at said end of said light enhancing member closest to said light emitter that is greater than a cross section of said reflector at said end of said reflector furthest from said light emitter.

6. The vehicle headlight as defined in claim 1, wherein the peripheral light enhancing member includes optical elements for at least one of diverting and dispersing said part of the light emitted from the light emitter received thereon.

7. A vehicle headlight as defined in claim 1, further comprising at least one supplemental reflector arranged between the lens and the reflector and wherein the supplemental reflector acts to reflect another fraction of said portion of the light emitted from the light emitter so that said another fraction passes through the peripheral light enhancing member.

8. A vehicle headlight comprising a light emitter for emitting light;

a reflector for reflecting a portion of the light emitted from the light emitter in a generally convergent arrangement;

a lens arranged so that a fraction of said portion of the light emitted from the light emitter that is reflected by the reflector passes through the lens, said lens having an outer periphery; and a peripheral light enhancing member disposed relative to the lens for receiving a part of the light emitted from the light emitter that does not pass through the lens and that exits the headlight;

wherein the peripheral light enhancing member generally borders at least a portion of the outer periphery of the lens and passes therethrough at least a fraction of said part of said light received by the peripheral light enhancing member and passes therethrough at least a portion of light falling on the headlight from outside of the headlight;

wherein the peripheral light enhancing member has an end closest to said light emitter, the reflector has an end furthest from said light emitter and said light enhancing member has a cross section at said end of said light enhancing member closest to said light emitter that is greater than a cross section of said reflector at said end of said reflector furthest from said light emitter.

9. The vehicle headlight as defined in claim 8, wherein the peripheral light enhancing member tapers in a direction toward the lens from the light emitter.

10. The vehicle headlight as defined in claim 8, further comprising a retaining element for retaining the lens and wherein said retaining element is provided with at least one aperture for permitting passage of light thereby to said peripheral light enhancing member.

11. The vehicle headlight as defined in claim 8, wherein the peripheral light enhancing member has a generally frustoconical shape.

12. The vehicle headlight as defined in claim 8, wherein the peripheral light enhancing member has a curved shape along at least a portion thereof.

13. The vehicle headlight as defined in claim 8, wherein the peripheral light enhancing member includes optical elements for at least one of diverting and dispersing said part of the light emitted from the light emitter received thereon.

14. A vehicle headlight as defined in claim 8, further comprising at least one supplemental reflector arranged between the lens and the reflector and wherein the supplemental reflector acts to reflect another fraction of said portion of the light emitted from the light emitter that is reflected by said reflector so that said another fraction passes through the peripheral light enhancing member.

15. A vehicle headlight comprising a light emitter for emitting light;

a reflector for reflecting a portion of the light emitted from the light emitter in a generally convergent arrangement;

a lens arranged so that a fraction of said portion of the light emitted from the light emitter that is reflected by the reflector passes through the lens, said lens having an outer periphery;

a peripheral light enhancing member disposed relative to the lens for receiving a part of the light emitted from the light emitter that does not pass through the lens and that exits the headlight; and at least one supplemental reflector arranged between the lens and the reflector and wherein the supplemental reflector acts to reflect another fraction of said portion of the light emitted from the light emitter that is reflected by said reflector so that said another fraction passes through the peripheral light enhancing member;

wherein the peripheral light enhancing member generally borders at least a portion of the outer periphery of the lens and passes therethrough at least a fraction of said part of said light received by the peripheral light enhancing member and passes therethrough at least a portion of light falling on the headlight from outside of the headlight.

16. The vehicle headlight as defined in claim 15, wherein the peripheral light enhancing member tapers in a direction toward the lens from the light emitter.

17. The vehicle headlight as defined in claim 15, further comprising a retaining element for retaining the lens and wherein said retaining element is provided with at least one aperture for permitting passage of light thereby to said peripheral light enhancing member.

18. The vehicle headlight as defined in claim 15, wherein the peripheral light enhancing member has a generally frustoconical shape.

19. The vehicle headlight as defined in claim 15, wherein the peripheral light enhancing member has a curved shape along at least a portion thereof.

20. The vehicle headlight as defined in claim 15, wherein the peripheral light enhancing member has an end closest to said light emitter, the reflector has an end furthest from said light emitter and said light enhancing member has a cross section at said end of said light enhancing member closest to said light emitter that is greater than a cross section of said reflector at said end of said reflector furthest from said light emitter.

21. The vehicle headlight as defined in claim 15, wherein the peripheral light enhancing member includes optical elements for at least one of diverting and dispersing said part of the light emitted from the light emitter received thereon.

22. A vehicle headlight comprising a light emitter for emitting light;

a reflector for reflecting a portion of the light emitted from the light emitter in a generally convergent arrangement;

a lens arranged so that a fraction of said portion of the light emitted from the light emitter that is reflected by the reflector passes through the lens, said lens having an outer periphery; and a peripheral light enhancing member disposed relative to the lens for receiving a part of the light emitted from the light emitter that does not pass through the lens and that exits the headlight;

wherein the peripheral light enhancing member generally borders at least a portion of the outer periphery of the lens and passes therethrough at least a fraction of said part of said light received by the peripheral light enhancing member and passes therethrough at least a portion of light falling on the headlight from outside of the headlight; and wherein the peripheral light enhancing member has a partially transmitting, partially reflecting coating arranged on said peripheral light enhancing member.

23. The vehicle headlight as defined in claim 22, wherein said coating is applied on an outer side of the peripheral light enhancing member and covers said outer side completely.

* * * * *